US009131295B2

(12) United States Patent
Kim et al.

(10) Patent No.: US 9,131,295 B2
(45) Date of Patent: Sep. 8, 2015

(54) MULTI-MICROPHONE AUDIO SOURCE SEPARATION BASED ON COMBINED STATISTICAL ANGLE DISTRIBUTIONS

(75) Inventors: Chanwoo Kim, Bellevue, WA (US); Charbel Khawand, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 571 days.

(21) Appl. No.: 13/569,092

(22) Filed: Aug. 7, 2012

(65) Prior Publication Data

US 2014/0044279 A1 Feb. 13, 2014

(51) Int. Cl.

*H04R 3/00* (2006.01)
*G10L 21/0272* (2013.01)
*H04R 27/00* (2006.01)

(52) U.S. Cl.

CPC ..... *H04R 3/005* (2013.01); *G10L 21/0272* (2013.01); *H04R 27/00* (2013.01); *H04R 2227/003* (2013.01); *H04R 2227/009* (2013.01)

(58) Field of Classification Search

CPC .. H04R 3/005; H04R 27/00; H04R 2227/009; H04R 2227/003; G10L 21/0272
USPC ..... 381/92, 122, 94.1, 91, 56, 82, 58
See application file for complete search history.

(56) References Cited

U.S. PATENT DOCUMENTS 5,940,118 A 8/1999 Van Schyndel
6,597,806 B1 7/2003 Kawada
6,845,164 B2 1/2005 Gustafsson
2002/0097885 A1 * 7/2002 Birchfield et al. ..... 381/92
2004/0001137 A1 1/2004 Cutler et al.
2005/0008169 A1 1/2005 Muren et al.
2008/0218582 A1 9/2008 Buckler
2009/0046139 A1 2/2009 Cutler et al.

(Continued)

FOREIGN PATENT DOCUMENTS

WO WO 96/22537 7/1996

OTHER PUBLICATIONS

P. Arabi and G. Shi, "Phase-Based Dual-Microphone Robust Speech Enhancement," IEEE Tran. Systems, Man, and Cybernetics-Part B: Cybernetics, 34(4):pp. 1763-1773, (Aug. 2004).

(Continued)

*Primary Examiner* — Paul S Kim
(74) *Attorney, Agent, or Firm* — Bryan Webster; Kate Drakos; Micky Minhas

(57) ABSTRACT

Systems, methods, and computer media for separating audio sources in a multi-microphone system are provided. A plurality of audio sample groups can be received. Each audio sample group comprises at least two samples of audio information captured by different microphones during a sample group time interval. For each audio sample group, an estimated angle between an audio source and the multi-microphone system can be estimated based on a phase difference of the samples in the group. The estimated angle can be modeled as a combined statistical distribution that is a mixture of a target audio signal statistical distribution and a noise component statistical distribution. The combined statistical distribution can be analyzed to provide an accurate characterization of each sample group as either target audio signal or noise. The target audio signal can then be resynthesized from samples identified as part of the target audio signal.

24 Claims, 7 Drawing Sheets

(56) References Cited

U.S. PATENT DOCUMENTS

| | | | |
|---|---|---|---|
| 2009/0052740 | A1 | 2/2009 | Sonoura |
| 2009/0055170 | A1 | 2/2009 | Nagahama |
| 2009/0066798 | A1 | 3/2009 | Oku et al. |
| 2009/0080876 | A1 | 3/2009 | Brusnitsyn et al. |
| 2010/0026780 | A1 | 2/2010 | Tico et al. |
| 2010/0070274 | A1 | 3/2010 | Cho et al. |
| 2010/0082340 | A1 | 4/2010 | Nakadai et al. |
| 2011/0015924 | A1 | 1/2011 | Gunel Hacihabiboglu et al. |
| 2011/0018862 | A1 | 1/2011 | Epps |
| 2011/0115945 | A1 | 5/2011 | Takano et al. |
| 2011/0221869 | A1 | 9/2011 | Yamaya et al. |
| 2012/0062702 | A1 | 3/2012 | Jiang et al. |
| 2012/0327194 | A1 | 12/2012 | Shiratori et al. |
| 2013/0050069 | A1 | 2/2013 | Ota |
| 2013/0151135 | A1 | 6/2013 | Aubrey et al. |
| 2013/0338962 | A1 | 12/2013 | Crandall |

OTHER PUBLICATIONS

J. Allen and D. Berkley, "Image method for efficiently simulating small-room acoustics," J. Acoust. Soc. Am., 65(4):pp. 943-950, (Apr. 1979).

Attias, "New EM Algorithms for Source Separation and Deconvolution with a Microphone Array," Microsoft Research, 4 pages.

Attias et al., "Speech Denoising and Dereverberation Using Probabilistic Models," Advances in Neural Information Processing Systems (NIPS), 13: pp. 758-764, (Dec. 3, 2001).

W. Grantham, "Spatial Hearing and Related Phenomena," Hearing, Academic Press, pp. 297-345 (1995).

Kim et al, "Signal Separation for Robust Speech Recognition Based on Phase Difference Information Obtained in the Frequency Domain," Interspeech, pp. 2495-2498 (Sep. 2009).

Kim et al., "Binaural Sound Source Separation Motivated by Auditory Processing," IEEE Int. Conf. on Acoustics, Speech, and Signal Processing, pp. 5072-5075 (May 2011).

Kim et al., Two-microphone source separation algorithm based on statistical modeling of angle distributions, in IEEE. Conf. Acoust, Speech, and Signal Processing, 4 pages, (Mar. 2012 accepted).

C. Kim and R. M. Stern, "Power-Normalized Cepstral Coefficients (PNCC) for Robust Speech Recognition," IEEE Trans. Audio, Speech, Lang. Process., (in submission).

S. G. McGovern, "A Model for Room Acoustics," http://2pi.us/rir.html.

H. Park, and R. M. Stern, "Spatial separation of speech signals using amplitude estimation based on interaural comparisons of zero crossings," Speech Communication, 51(1):pp. 15- 25, (Jan. 2009).

Lucas Parra and Clay Spence, "Convolutive Blind Separation of Non-Stationary Sources," IEEE transactions on speech and audio processing, 8(3):pp. 320-327, (May 2005).

Roweis, "One Microphone Source Separation," http://www.ece.uvic.ca/~bctill/papers/singchan/onemic.pdf, pp. 793-799 (Apr. 3, 2012).

Srinivasan et al, "Binary and ratio time-frequency masks for robust speech recognition," Speech Comm., 48:pp. 1486-1501, (2006).

Wang et al., "Video Assisted Speech Source Separation," IEEE International Conference on Acoustics, Speech, and Signal Processing, pp. 425-428 (Mar. 18, 2005).

Weiss, "Underdetermined Source Separation Using Speaker Subspace Models," http://www.ee.columbia.edu/~ronw/pubs/ronw-thesis.pdf, 134 pages, (Retrieved: Apr. 3, 2012).

Asano, et al., "Fusion of Audio and Video Information for Detecting Speech Events", In Proceedings of the Sixth International Conference of Information Fusion, vol. 1, Jul. 8, 2003, pp. 386-393.

International Search Report and Written Opinion from International Application No. PCT/US2013/055231, dated Nov. 4, 2013, 12 pp.

Nakadai et al., "Real-Time Speaker Localization and Speech Separation by Audio-Visual Integration," *Proceedings* 2002 *IEEE International Conference on Robotics and Automation*, 1: 1043-1049 (2002).

Wang et al, "Image and Video Based Remote Target Localization and Tracking on Smartphones," *Geospatial Infofusion II, SPIE*, 8396(1): 1-9 (May 11, 2012).

Office action dated Apr. 6, 2015, from U.S. Appl. No. 13/592,890, 24 pp.

* cited by examiner

MULTI-MICROPHONE AUDIO SOURCE SEPARATION BASED ON COMBINED STATISTICAL ANGLE DISTRIBUTIONS

FIELD

The present application relates generally to audio source separation and speech recognition.

BACKGROUND

Speech recognition systems have become widespread with the proliferation of mobile devices having advanced audio and video recording capabilities. Speech recognition techniques have improved significantly in recent years as a result. Advanced speech recognition systems can now achieve high accuracy in clean environments. Even advanced speech recognition systems, however, suffer from serious performance degradation in noisy environments. Such noisy environments often include a variety of speakers and background noises. Mobile devices and other consumer devices are often used in these environments. Separating target audio signals, such as speech from a particular speaker, from noise thus remains an issue for speech recognition systems that are typically used in difficult acoustical environments.

Many algorithms have been developed to address these problems and can successfully reduce the impact of stationary noise. Nevertheless, improvement in non-stationary noise remains elusive. In recent years, researchers have explored an approach to separating target audio signals from noise in multi-microphone systems based on an analysis of differences in arrival time at different microphones. Such research has involved attempts to mimic the human binaural system, which is remarkable in its ability to separate speech from interfering sources. Models and algorithms have been developed using interaural time differences (ITDs), interaural intensity difference (IIDs), interaural phase differences (IPDs), and other cues. Existing source-separation algorithms and models, however, are still lacking in non-stationary noise reduction.

SUMMARY

Embodiments described herein relate to separating audio sources in a multi-microphone system. Using the systems, methods, and computer media described herein, a target audio signal can be distinguished from noise. A plurality of audio sample groups can be received. Audio sample groups comprise at least two samples of audio information captured by different microphones during a sample group time interval. Audio sample groups can then be analyzed to determine whether the audio sample group is part of a target audio signal or a noise component.

For a plurality of audio sample groups, an angle between a first reference line extending from an audio source to the multi-microphone system and a second reference line extending through the multi-microphone system can be estimated. The estimated angle is based on a phase difference between the at least two samples in the audio sample group. The estimated angle can be modeled as a combined statistical distribution, the combined statistical distribution being a mixture of a target audio signal statistical distribution and a noise component statistical distribution. Whether the audio sample group is part of a target audio signal or a noise component can be determined based at least in part on the combined statistical distribution.

In one embodiment, the target audio signal statistical distribution and the noise component statistical distribution are von Mises distributions. In another embodiment, the determination of whether the audio sample pair is part of the target audio signal or the noise component comprises performing statistical analysis on the combined statistical distribution. The statistical analysis may include hypothesis testing such as maximum a posteriori (MAP) hypothesis testing or maximum likelihood testing. In still another embodiment, a target audio signal can be resynthesized from audio sample pairs determined to be part of a target audio signal.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The foregoing and other objects, features, and advantages of the claimed subject matter will become more apparent from the following detailed description, which proceeds with reference to the accompanying figures.

DETAILED DESCRIPTION

Embodiments described herein provide systems, methods, and computer media for distinguishing a target audio signal and resynthesizing a target audio signal from audio samples in multi-microphone systems. In accordance with some embodiments, an estimated angle between a first reference line extending from an audio source to a multi-microphone system and a second reference line extending through the multi-microphone system can be estimated and modeled as a combined statistical distribution. The combined statistical distribution is a mixture of a target audio signal statistical distribution and a noise component statistical distribution.

Most conventional algorithms for multi-microphone systems, in contrast, simply compare an estimated angle for a sample group to a fixed threshold angle or interaural time difference (ITD) to determine whether the audio signal for the sample pair is likely to originate from the target or a noise source. Such an approach provides limited accuracy in noisy environments. By modeling the estimated angle as a combined statistical distribution, embodiments are able to more accurately determine whether an audio sample group is part of the target audio signal or the noise component.

Embodiments can be described as applying statistical modeling of angle distributions (SMAD). Embodiments are also described below that employ a variation of SMAD described as statistical modeling of angle distributions with channel weighting (SMAD-CW). SMAD embodiments are discussed first below, followed by a detailed discussion of SMAD-CW embodiments.

SMAD Embodiments

Figure 1:
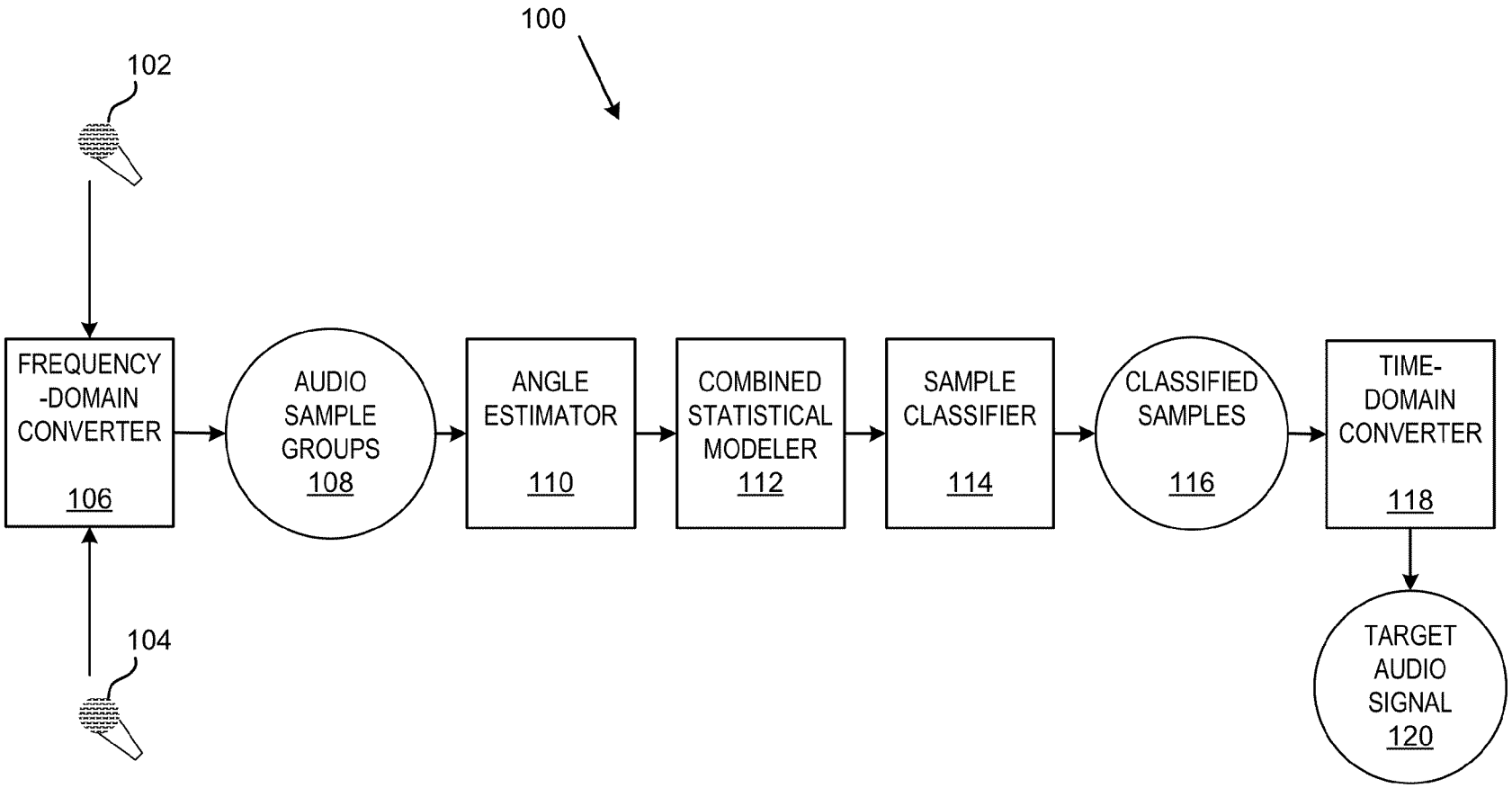
FIG. 1 is a block diagram of an exemplary speech recognition system.

FIG. 1 illustrates an exemplary speech recognition system 100. Microphones 102 and 104 capture audio from the surrounding environment. Frequency-domain converter 106 converts captured audio from the time domain to the frequency domain. This can be accomplished, for example, via short-time Fourier transforms. Frequency-domain converter 106 outputs audio sample groups 108. Each audio sample group comprises at least two samples of audio information, the at least two samples captured by different microphones during a sample group time interval. For a two-microphone system such as system 100, audio sample groups 108 are audio sample pairs.

Figure 2:
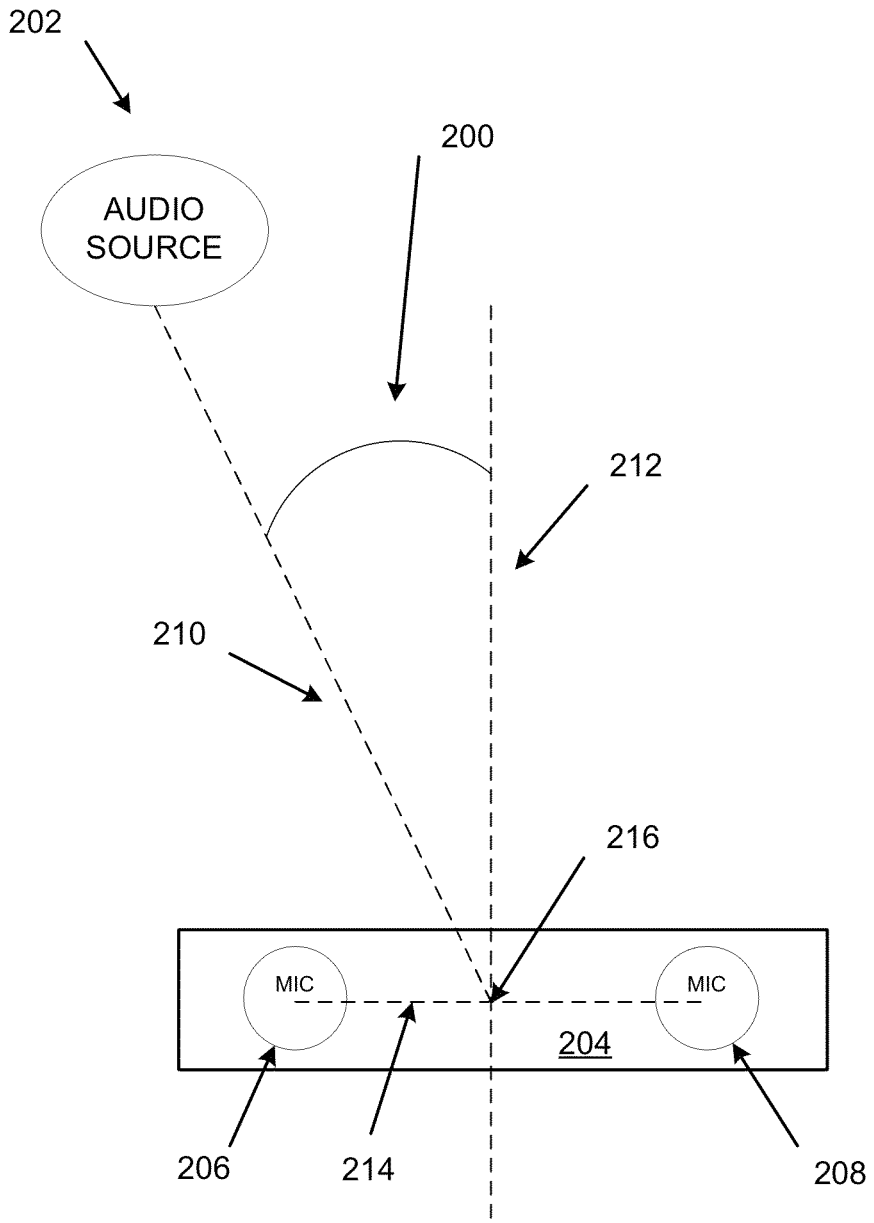
FIG. 2 is a block diagram illustrating an exemplary angle between an audio source and a multi-microphone system.

Angle estimator 110 estimates an angle for the sample group time interval corresponding to each sample group. The angle estimated is the angle between a first reference line extending from an audio source to the multi-microphone system and a second reference line extending through the multi-microphone system that captured the samples. The estimated angle is determined based on a phase difference between the at least two samples in the audio sample group. An exemplary angle 200 is illustrated in FIG. 2. An exemplary angle estimation process is described in more detail below with respect to FIG. 5.

In FIG. 2, an angle 200 is shown between an audio source 202 and a multi-microphone system 204 having two microphones 206 and 208. Angle 200 is the angle between first reference line 210 and second reference line 212. First reference line 210 extends between audio source 202 and multi-microphone system 204, and second reference line 212 extends through multi-microphone system 204. In this example, second reference line 212 is perpendicular to a third reference line 214 that extends between microphone 206 and microphone 208. First reference line 210 and second reference line 212 intersect at the approximate midpoint 216 of third reference line 214. In other embodiments, the reference lines and points of intersection of reference lines are different.

Returning now to FIG. 1, combined statistical modeler 112 models the estimated angle as a combined statistical distribution, the combined statistical distribution being a mixture of a target audio signal statistical distribution and a noise component statistical distribution. In some embodiments, the target audio signal statistical distribution and the noise component statistical distribution are von Mises distributions. The von Mises distribution, which is a close approximation to the wrapped normal distribution, is an appropriate choice where it is assumed that the angle is limited to between +/−90 degrees (such as the example shown in FIG. 2). Other statistical distributions, such as the Gaussian distribution, may also be used. Defined statistical distributions, such as von Mises, Gaussian, and other distributions, include a variety of parameters. Parameters for the combined statistical distribution can be determined, for example, using the expectation-maximization (EM) algorithm.

Sample classifier 114 determines whether the audio sample group is part of a target audio signal or a noise component based at least in part on the combined statistical distribution produced by combined statistical modeler 112. Sample classifier 114 may be implemented in a variety of ways. In one embodiment, the combined statistical distribution is compared to a fixed threshold to determine whether an audio sample group is part of the target audio signal or the noise component. The fixed threshold may be an angle or angle range. In another embodiment, the determination of target audio or noise is made by performing statistical analysis on the combined statistical distribution. This statistical analysis may comprise hypothesis testing such as maximum a posteriori (MAP) hypothesis testing or maximum likelihood testing. Other likelihood or hypothesis testing techniques may also be used.

Classified sample groups 116 are provided to time-domain converter 118. Time-domain converter 118 converts sample groups determined to be part of the target audio signal back to the time domain. This can be accomplished, for example, using a short-time inverse Fourier transform (STIFT). Resynthesized target audio signal 120 can be resynthesized by combining sample groups that were determined to be part of the target audio signal. This can be accomplished, for example, using overlap and add (OLA), which allows resynthesized target audio signal 120 to be the same duration as the combined time of the sample group intervals for which audio information was captured while still removing sample groups determined to be noise.

Throughout this application, examples and illustrations show two microphones for clarity. It should be understood that embodiments can be expanded to include additional microphones and corresponding additional audio information. In some embodiments, more than two microphones are included in the system, and samples from any two of the microphones may be analyzed for a given time interval. In other embodiments, samples for three or more microphones may be analyzed for the time interval.

Figure 3:
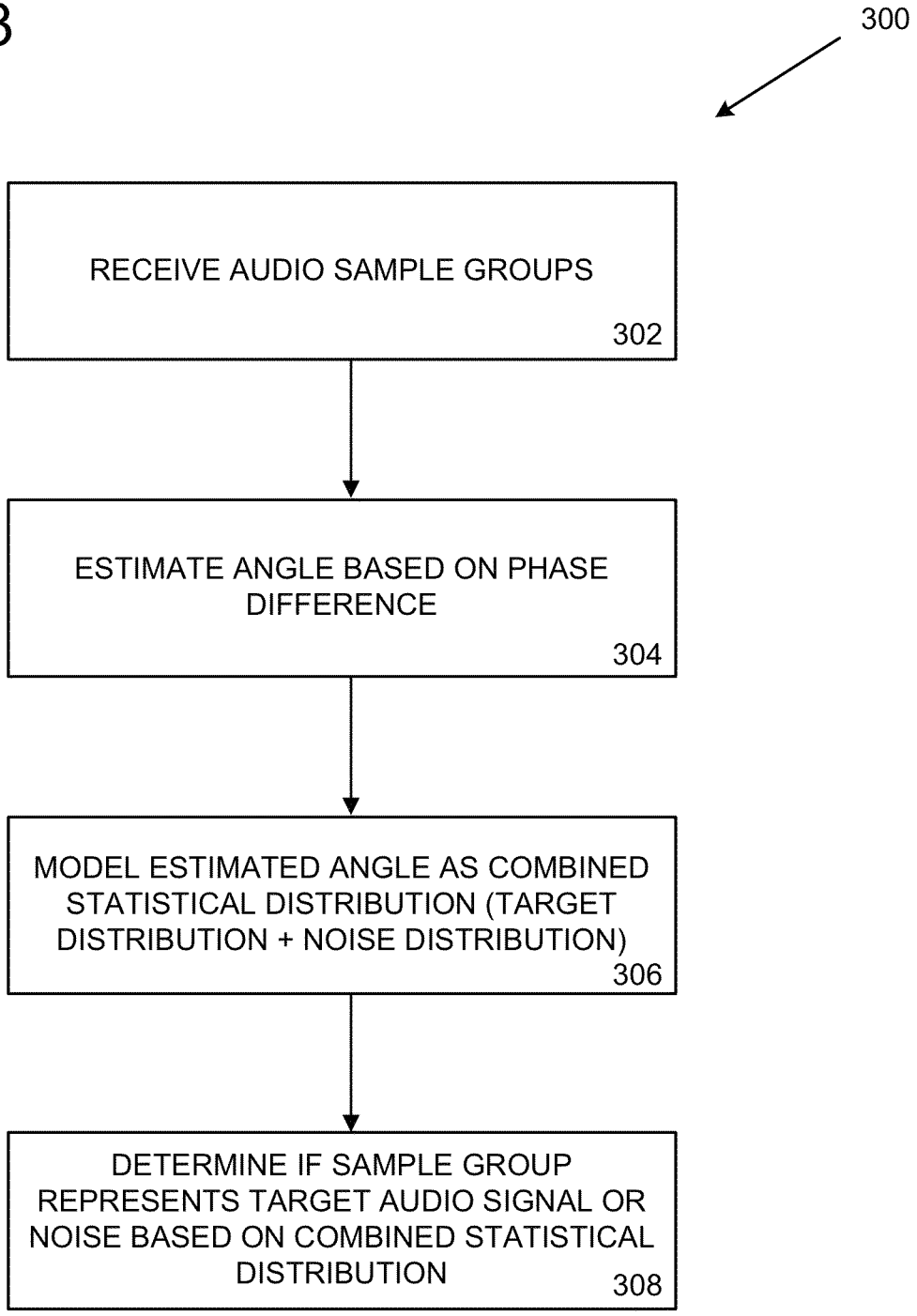
FIG. 3 is a flowchart of an exemplary method for separating audio sources in a multi-microphone system.

FIG. 3 illustrates a method 300 for distinguishing a target audio signal in a multi-microphone system. In process block 302, audio sample groups are received. Audio sample groups comprise at least two samples of audio information. The at least two samples captured by different microphones during a sample group time interval. Audio sample groups may be received, for example, from a frequency-domain converter that converts time-domain audio captured by the different microphones to frequency-domain samples. Additional preprocessing of audio captured by the different microphones is also possible prior to the audio sample groups being received in process block 302. Process blocks 304, 306, and 308 can be performed for each received audio sample group. In process block 304, an angle is estimated, for the corresponding sample group time interval, between a first reference line extending from an audio source to the multi-microphone system and a second reference line extending through the multi-microphone system. The estimated angle is based on a phase difference between the at least two samples in the audio sample group. In process block 306, the estimated angle is modeled as a combined statistical distribution. The combined statistical distribution is a mixture of a target audio signal statistical distribution and a noise component statistical distribution. A combined statistical distribution can be represented by the following equation:

$$f_T(\theta)=c_0[m]f_0(\theta)+c_1[m]f_1(\theta)$$

where m is the sample group index, $f_0(\theta)$ is the noise component distribution, $f_1(\theta)$ is the target audio signal distribution, $c_0[m]$ and $c_1[m]$ are mixture coefficients, and $c_0[m]+c_1[m]=1$. It is determined in process block 308 whether the audio sample group is part of a target audio signal or a noise component based at least in part on the combined statistical distribution.

Figure 4:
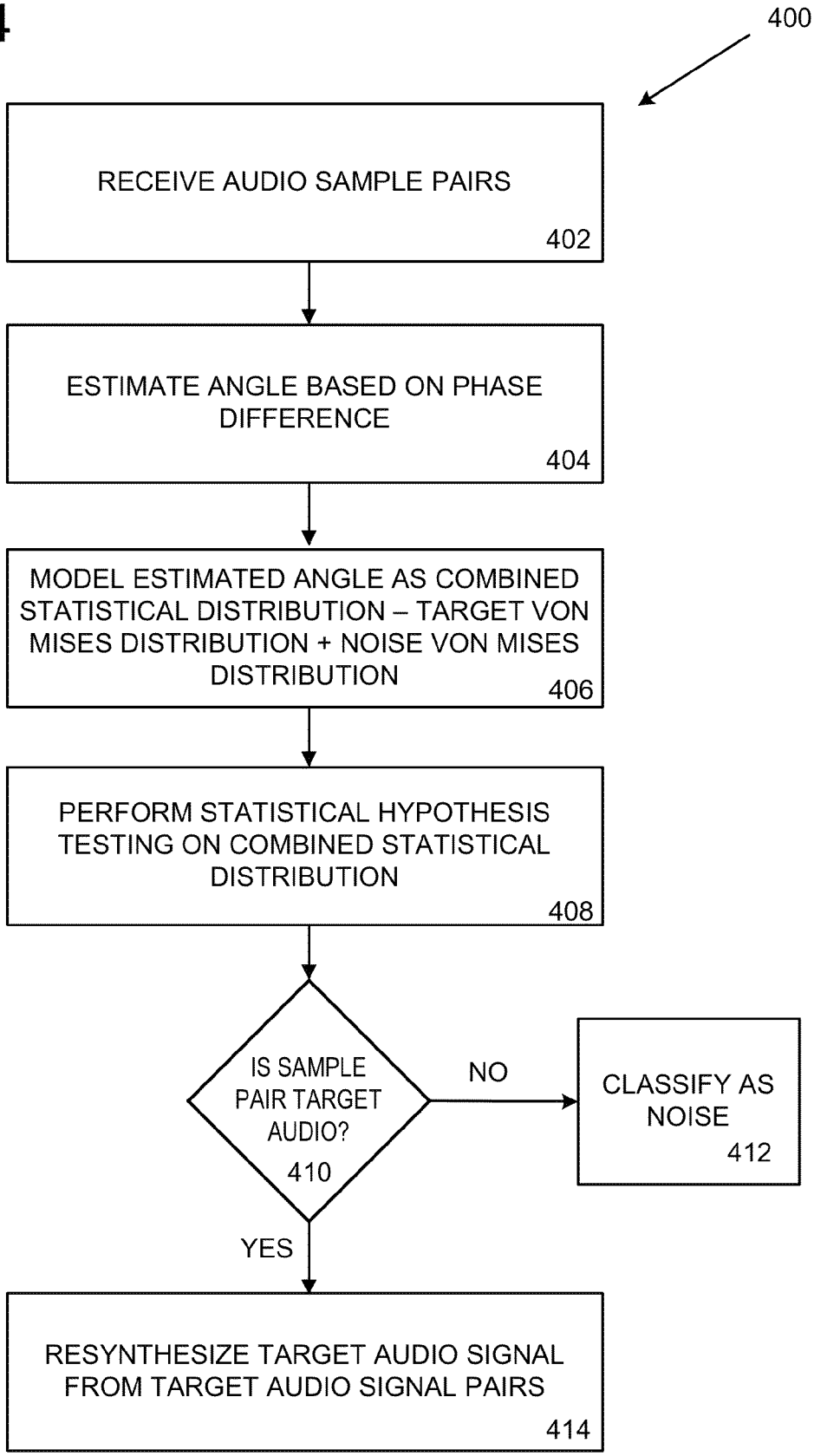
FIG. 4 is a flowchart of an exemplary method for providing a target audio signal through audio source separation in a two-microphone system.

FIG. 4 illustrates a method 400 for providing a target audio signal through audio source separation in a two-microphone system. Audio sample pairs are received in process block 402. Audio sample pairs comprise a first sample of audio information captured by a first microphone during a sample pair time interval and a second sample of audio information captured by a second microphone during the sample pair time interval. Process blocks 404, 406, 408, and 410 can be performed for each of the received audio sample pairs. In process block 404, an angle is estimated, for the corresponding sample pair time interval, between a first reference line extending from an audio source to the two-microphone system and a second reference line extending through the two-microphone system. The estimated angle is based on a phase difference between the first and second samples of audio information.

In process block 406, the estimated angle is modeled as a combined statistical distribution, the combined statistical distribution being a mixture of a target audio signal von Mises distribution and a noise component von Mises distribution. The combined statistical distribution can be represented by the following equation:

$$f_T(\theta|M[m])=c_0[m]f_0(\theta|\mu_0[m],\kappa_0[m])+c_1[m]f_1(\theta|\mu_2[m],\kappa_1[m])$$

where m is the sample group index, the subscript 0 refers to the noise component, the subscript 1 refers to the target audio signal, $f_0(\theta)$ is the noise component distribution, $f_1(\theta)$ is the target audio signal distribution, $c_0[m]$ and $c_1[m]$ are mixture coefficients, and $c_0[m]+c_1[m]=1$. M[m] is the set of parameters of the combined statistical distribution. For the von Mises distribution, the set of parameters is defined as:

$$M[m]=\{c_1[m], \mu_0[m], \mu_1[m], \kappa_0[m], \kappa_1[m]\}$$

The von Mises distribution parameters are defined further in the discussion of FIG. 5 below. In process block 408, statistical hypothesis testing is performed on the combined statistical distribution. In some embodiments, the hypothesis testing is one of maximum a posteriori (MAP) hypothesis testing or maximum likelihood testing. Based on the performed statistical hypothesis testing, it is determined in process block 410 whether the audio sample pair is part of the target audio signal or the noise component. If the sample pair is not part of the target audio signal, then the sample pair is classified as noise in process block 412. If the sample pair is determined to be part of the target audio signal, then it is classified as target audio. In process block 414, the target audio signal is resynthesized from the audio sample pairs classified as target audio.

SMAD-CW Embodiments

Figure 5:
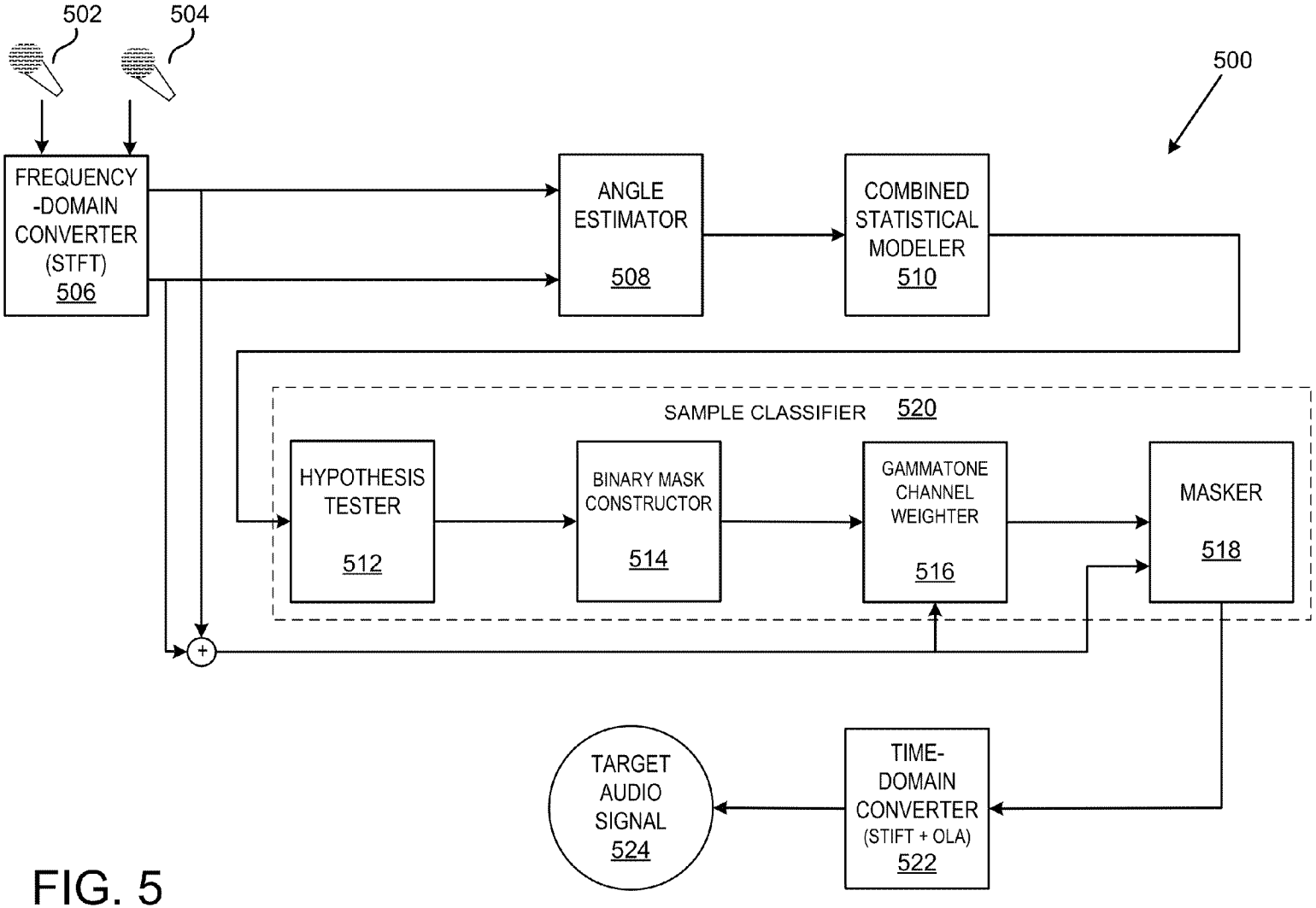
FIG. 5 is a block diagram illustrating an exemplary two-microphone speech recognition system showing exemplary sample classifier components.

FIG. 5 illustrates a two-microphone speech recognition system 500 capable of employing statistical modeling of angle distributions with channel weighting (SMAD-CW). Two-microphone system 500 includes microphone 502 and microphone 504. System 500 implementing SMAD-CW emulates selected aspects of human binaural processing. The discussion of FIG. 5 assumes a sampling rate of 16 kHz and 4 cm between microphones 502 and 504, such as could be the case on a mobile device. Other sampling frequencies and microphone separation distances could also be used. In the discussion of FIG. 5, it is assumed that the location of the target audio source is known a priori, and lies along the perpendicular bisector of the line between the two microphones.

Sample pairs, captured at microphones 502 and 504 during sample pair time intervals, are received by frequency-domain converter 506. Frequency-domain converter 506 performs short-time Fourier transforms (STFTs) using Hamming windows of duration 75 milliseconds (ms), 37.5 ms between successive frames, and a DFT size of 2048. In other embodiments, different durations are used, for example, between 50 and 125 ms.

For each sample pair (also described as a time-frequency bin or frame), the direction of the audio source is estimated indirectly by angle estimator 508 by comparing the phase information from microphones 502 and 504. Either the angle or ITD information can be used as a statistic to represent the direction of the audio source, as is discussed below in more detail. Combined statistical modeler 510 models the angle distribution for each sample pair as a combined statistical distribution that is a mixture of two von Mises distributions—one from the target audio source and one from the noise component. Parameters of the distribution are estimated using the EM algorithm as discussed below in detail.

After parameters of the combined statistical distribution are obtained, hypothesis tester 512 performs MAP testing on each sample pair. Binary mask constructor 514 then constructs binary masks based on whether a specific sample pair is likely to represent the target audio signal or noise component. Gammatone channel weighter 516 performs gammatone channel weighting to improve speech recognition accuracy in noisy environments. Gammatone channel weighting is performed prior to masker 518 applying the constructed binary mask. In gammatone channel weighting, the ratio of power after applying the binary mask to the original power is obtained for each channel, which is subsequently used to modify the original input spectrum, as described in detail below. Hypothesis tester 512, binary mask constructor 514, gammatone channel weighter 516, and masker 518 together form sample classifier 520. In various embodiments, sample classifier 520 contains fewer components, additional components, or components with different functionality. Frequency-domain converter 522 resynthesizes the target audio signal 524 through STIFT and OLA. The functions of several of the components of system 500 are discussed in detail below.

Angle Estimator

For each sample pair, the phase differences between the left and right spectra are used to estimate the inter-microphone time difference (ITD). The STFT of the signals from the left and right microphones are represented by $X_L[m, e^{j\omega_k}]$ and $X_R[m, e^{j\omega_k}]$, where $\omega_k=2\pi k/N$, where N is the FFT size. The ITD at frame index m and frequency index k is referred to as $\tau[m,k]$. The following relationship can then be obtained:

$$\phi[m,k] \triangleq \angle X_R[m, e^{j\omega_k}) - \angle X_L[m, e^{j\omega_k}) = \omega_k \tau[m,k] + 2\pi l \tag{1}$$

where l is an integer chosen such that $$\omega_k \tau[m,k] = \begin{cases} \phi[m,k], & \text{if } |\phi[m,k]| \le \pi \\ \phi[m,k] - 2\pi, & \text{if } \phi[m,k] \ge \pi \\ \phi[m,k] + 2\pi, & \text{if } \phi[m,k] < -\pi \end{cases} \tag{2}$$

In the discussion of FIG. 5, only values of the frequency index k that correspond to positive frequency components $0 \le k \le \pi/2$ are considered.

If a sound source is located along a line of angle 0[m,k] with respect to the perpendicular bisector to the line between microphones 502 and 504, geometric considerations determine the ITD $\tau[m, k]$ to be $$\tau[m, k] = \frac{d\sin(\theta[m, k])}{c_{air}} f_s \tag{3}$$

where $c_{air}$ is the speed of sound in air (assumed to be 340 m/s) and $f_s$ is the sampling rate.

While in principle $|\tau[m, k]|$ cannot be larger than $\tau_{max}=f_s d/c_{air}$ from Eq. 3, in real environments $|\tau[m, k]|$ may be larger than $\tau_{max}$ because of approximations in the assumptions made if ITD is estimated directly from Eq. (2). For this reason, $\tau[m, k]$ can be limited to lie between $-\tau_{max}$ and $\tau_{max}$, and this limited ITD estimate can be referred to as $\tilde{\tau}[m, k]$. The estimated angle $\theta[m, k]$ is obtained from $\tilde{\tau}[m, k]$ using $$\theta[m, k] = a\sin\left(\frac{c_{air}\tilde{\tau}[m, k]}{f_a d}\right) \tag{4}$$

Combined Statistical Modeler

For each frame, the distribution of estimated angles $\theta[m, k]$ is modeled as a mixture of the target audio signal distribution and noise component distribution:

$$f_T(\theta|M[m])=c_0[m]f_0(\theta|\mu_0[m], \kappa_0[m])+c_1[m]f_1(\theta|\mu_1[m], \kappa_1[m]) \tag{5}$$

where m is the sample group index, the subscript 0 refers to the noise component, the subscript 1 refers to the target audio signal, $f_0(\theta)$ is the noise component distribution, $f_1(\theta)$ is the target audio signal distribution, $c_0[m]$ and $c_1[m]$ are mixture coefficients, and $c_0[m]+c_1[m]=1$. M[m] is the set of parameters of the combined statistical distribution. For the von Mises distribution, the set of parameters is defined as:

$$\mathcal{M}[m] = \{c_1[m], \mu_0[m], \mu_1[m], K_0[m], K_1[m]\} \tag{6}$$

$f_1(\theta|\mu_1[m], K_1[m])$ and $f_0(\theta|\mu_0|m], K_0[m])$ are given as follows:

$$f_0(\theta \mid \mu_0[m], K_0[m]) = \frac{\exp(K_0[m]\cos(2\theta - \mu_0[m]))}{\pi I_0(K_0[m])} \tag{7a}$$

$$f_1(\theta \mid \mu_1[m], K_1[m]) = \frac{\exp(K_1[m]\cos(2\theta - \mu_1[m]))}{\pi I_0(K_1[m])} \tag{7b}$$

The coefficient $c_0[m]$ follows directly from the constraint that $c_0[m]+c_1[m]=1$. Because the parameters M[m] cannot be directly estimated in closed form, they are obtained using the EM algorithm. Other algorithms such as segmental K-means or any similar algorithm could also be used to obtain the parameters. The following constraints are imposed in parameter estimation:

$$0 \le |\mu_1[m]| \le \theta_0 \tag{8a}$$

$$\theta_0 \le |\mu_0[m]| \le \frac{\pi}{2} \tag{8b}$$

$$\theta_0 \le |\mu_1[m] - \mu_0[m]| \tag{8c}$$

where $\theta_0$ is a fixed angle that equals $15\pi/180$. This constraint is applied both in the initial stage and the update stage explained below. Without this constraint $\mu_0[m]$ and $\kappa_0[m]$ may converge to the target mixture or $\mu_1[m]$ and $\kappa_1[m]$ may converge to the noise (or interference) mixture, which would be problematic.

Initial parameter estimation: To obtain the initial parameters of M[m], the following two partitions of the frequency index k are considered $$K_0[m]=\{k||\theta[m, k]|\ge\theta_0, 0\le k\le N/2\} \tag{9a}$$

$$K_1[m]=\{k||\theta[m, k]|<\theta_0, 0\le k\le N/2\} \tag{9b}$$

In this initial step, if it is assumed that if the frequency index k belongs to $\kappa_1[m]$, then this time-frequency bin (sample pair) is dominated by the target audio signal. Otherwise, it is assumed that it is dominated by the noise component. This initial step is similar to approaches using a fixed threshold. Consider a variable z[m,k], which is defined as follows:

$$z[m, k]=e^{j2\theta[m, k]} \tag{10}$$

The weighted average $\bar{z}_j^{(0)}[m]$, j=0, 1 is defined as:

$$\bar{z}_j^{(0)}[m] = \frac{\sum_{k=0}^{N/2} \rho[m, k]||(\theta[m, k] \in \mathcal{K}_j)z[m, k]}{\sum_{k=0}^{N/2} \rho[m, k]||(\theta[m, k] \in \mathcal{K}_j)}, \tag{11}$$

where the function resembling "II" is the indicator function. The following equations (j=0, 1) are used in analogy to Eq. (17):

$$c_j^{(0)}[m] = \frac{\sum_{k\in\mathcal{K}_j} \rho[m, k]}{\sum_{k=0}^{N/2} \rho[m, k]} \tag{12a}$$

$$\mu_j^{(0)}[m] = \mathrm{Arg}(\bar{z}_j^{(0)}[m]) \tag{12b}$$

$$\frac{I_1(K_j^{(0)}[m])}{I_0(K_j^{(0)}[m])} = |\bar{z}_j^{(0)}[m]| \tag{12c}$$

where $I_0(\kappa_j)$ and $I_1(\kappa_j)$ are modified Bessel functions of the zeroth and first order.

Parameter update: The E-step of the EM algorithm is given as follows:

$$\tilde{Q}(\mathcal{M}[m], \mathcal{M}^{(t)}[m]) = \sum_{k=0}^{N/2} \rho[m, k]E[\log f_T(\theta[m, k], s[m, k] \mid \theta[m, k], \mathcal{M}^{(t)}[m])] \tag{13}$$

where $\rho[m, k]$ is a weighting coefficient defined by $\rho[m, k]=|X_A[m, e^{j\omega_k})|^2$ and s[m, k] is the latent variable denoting whether the $k^{th}$ frequency element originates from the target audio source or the noise component. $X_A[m, e^{j\omega_k})$ is defined by:

$$X_A[m, e^{j\omega k})=[X_L[m, e^{j\omega k})+X_R[m, e^{j\omega k})]/2 \tag{14}$$

Given the current estimated model $M^{(t)}[m]$, the conditional probability $T_j^{(t)}[m, k]$, j=0, 1 is defined as follows:

$$T_j^{(t)}[m, k] = P(s[m, k] = j \mid \theta[m, k], \mathcal{M}^{(t)}[m]), \quad (15)$$
$$= \frac{c_j^{(t)} f_j(\theta[m, k] \mid \mu j, K_j)}{\sum_{j=0}^{1} c_j^{(t)} f_j(\theta[m, k] \mid \mu_j, K_j)}$$

The weighted mean of $\bar{z}_j^{(t)}[m]$, j=0, 1 is defined as follows:

$$\bar{z}_j^{(t)}[m] = \frac{\sum_{k=0}^{N/2} \rho[m, k] T_j^{(t)}[m, k] z[m, k]}{\sum_{k=0}^{N/2} \rho[m, k] T_j^{(t)}[m, k]} \quad (16)$$

Using Eqs. (15) and (16), it can be shown that the following update equations (j=0, 1) maximize Eq. (13):

$$c_j^{(t+1)}[m] = \frac{\sum_{k=0}^{\frac{N}{2}} \rho[m, k] T_j^{(t)}[m, k]}{\sum_{k=0}^{\frac{N}{2}} \rho[m, k]} \quad (17a)$$

$$\mu_j^{(t+1)}[m] = \text{Arg}\,(\bar{z}_j^{(t)}[m]) \quad (17b)$$

$$\frac{I_1(K_j^{(t+1)}[m])}{I_0(K_j^{(t+1)}[m])} = |\bar{z}_j^{(t)}[m]| \quad (17c)$$

Assuming that the target speaker does not move rapidly with respect to the microphone, the following smoothing can be applied to improve performance:

$$\tilde{\mu}_1[m] = \lambda \mu_1[m-1] + (1-\lambda)\mu_1[m] \quad (18)$$

$$\tilde{\kappa}_1[m] = \lambda \kappa_1[m-1] + (1-\lambda)\kappa_1[m] \quad (19)$$

with the forgetting factor λ equal to 0.95. The parameters $\tilde{\mu}_1[m]$ and $\tilde{\kappa}_1[m]$ are used instead of $\mu_1[m]$ and $\kappa_1[m]$ in subsequent iterations. This smoothing is not applied to the representation of the noise component.

Hypothesis Tester

Using the obtained model M[m] and Eq. (7), the following MAP decision criterion can be obtained:

$$g[m, k] \underset{H_0}{\overset{H_1}{\gtrless}} \eta[m] \quad (20)$$

where g[m,k] and η[m] are defined as follows:

$$g[m, k] = K_1[m]\cos(2\theta[m, k] - \mu_1[m]) - K_0[m]\cos(2\theta[m, k] - \mu_0[m]) \quad (21)$$

$$\eta[m] = \ln\left(\frac{I_0(K_1[m])c_0[m]}{I_0(K_0[m])c_1[m]}\right) \quad (22)$$

Binary Mask Constructor and Masker

Using Eq. (20, a binary mask μ[m, k] can be constructed for each frequency index k as follows:

$$\mu[m, k] = \begin{cases} 1 & \text{if } g[m, k] \geq \eta[m] \\ 0 & \text{if } g[m, k] < \eta[m] \end{cases} \quad (23)$$

Processed spectra are obtained by applying the mask μ[m, k]. The target audio signal can be resynthesized using STIFT and OLA.

Gammatone Channel Weighter

To reduce the impact of discontinuities associated with binary masks, a weighting coefficient is obtained for each channel. Embodiments that do not apply channel weighting are referred to as SMAD rather than SMAD-CW, as discussed above. Each channel is associated with $H_1(e^{j\omega_k})$, the frequency response of one of a set of gammatone filters. Let ω[m,l] be the square root of the ratio of the output power to the input power for frame index m and channel index l:

$$w[m, l] = \max\left(\sqrt{\frac{\sum_{k=0}^{\frac{N}{2}-1} |X_A[m, e^{j\omega_k})\mu[m, k]H_l(e^{j\omega_k})|^2}{\sum_{k=0}^{\frac{N}{2}-1} |X_A[m, e^{j\omega_k})H_l(e^{j\omega_k})|^2}}, \delta\right) \quad (24)$$

where δ is a flooring coefficient that is set to 0.01 in certain embodiments. Using ω[m, l], target audio can be resynthesized.

Exemplary Mobile Device

Figure 6:
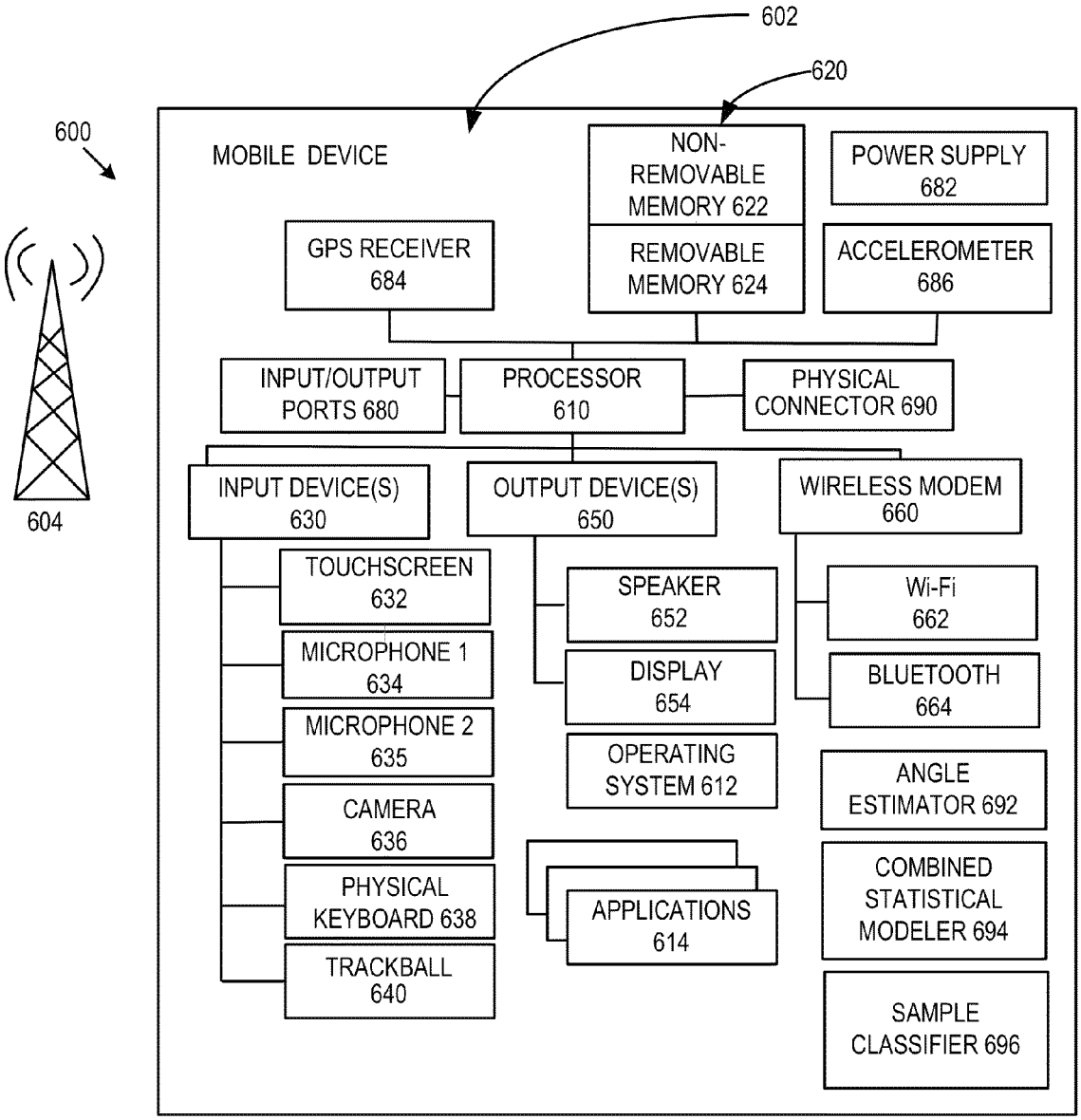
FIG. 6 is a diagram of an exemplary mobile phone having audio source-separation capabilities in which some described embodiments can be implemented.

FIG. 6 is a system diagram depicting an exemplary mobile device 600 including a variety of optional hardware and software components, shown generally at 602. Any components 602 in the mobile device can communicate with any other component, although not all connections are shown, for ease of illustration. The mobile device can be any of a variety of computing devices (e.g., cell phone, smartphone, handheld computer, Personal Digital Assistant (PDA), etc.) and can allow wireless two-way communications with one or more mobile communications networks 604, such as a cellular or satellite network.

The illustrated mobile device 600 can include a controller or processor 610 (e.g., signal processor, microprocessor, ASIC, or other control and processing logic circuitry) for performing such tasks as signal coding, data processing, input/output processing, power control, and/or other functions. An operating system 612 can control the allocation and usage of the components 602 and support for one or more application programs 614. The application programs can include common mobile computing applications (e.g., email applications, calendars, contact managers, web browsers, messaging applications), or any other computing application.

The illustrated mobile device 600 can include memory 620. Memory 620 can include non-removable memory 622 and/or removable memory 624. The non-removable memory 622 can include RAM, ROM, flash memory, a hard disk, or other well-known memory storage technologies. The removable memory 624 can include flash memory or a Subscriber Identity Module (SIM) card, which is well known in GSM communication systems, or other well-known memory storage technologies, such as "smart cards." The memory 620 can be used for storing data and/or code for running the operating system 612 and the applications 614. Example data can include web pages, text, images, sound files, video data, or other data sets to be sent to and/or received from one or more network servers or other devices via one or more wired or wireless networks. The memory 620 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The mobile device 600 can support one or more input devices 630, such as a touchscreen 632, microphone 634, camera 636, physical keyboard 638 and/or trackball 640 and one or more output devices 850, such as a speaker 652 and a display 654. Other possible output devices (not shown) can include piezoelectric or other haptic output devices. Some devices can serve more than one input/output function. For example, touchscreen with user-resizable icons 632 and display 654 can be combined in a single input/output device. The input devices 630 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 612 or applications 614 can comprise speech-recognition software as part of a voice user interface that allows a user to operate the device 600 via voice commands. Further, the device 600 can comprise input devices and software that allows for user interaction via a user's spatial gestures, such as detecting and interpreting gestures to provide input to a gaming application.

A wireless modem 660 can be coupled to an antenna (not shown) and can support two-way communications between the processor 610 and external devices, as is well understood in the art. The modem 660 is shown generically and can include a cellular modem for communicating with the mobile communication network 604 and/or other radio-based modems (e.g., Bluetooth or Wi-Fi). The wireless modem 660 is typically configured for communication with one or more cellular networks, such as a GSM network for data and voice communications within a single cellular network, between cellular networks, or between the mobile device and a public switched telephone network (PSTN).

The mobile device can further include at least one input/output port 680, a power supply 682, a satellite navigation system receiver 684, such as a Global Positioning System (GPS) receiver, an accelerometer 686, and/or a physical connector 690, which can be a USB port, IEEE 1394 (FireWire) port, and/or RS-232 port.

Mobile device 600 can also include angle estimator 692, combined statistical modeler 694, and sample classifier 696, which can be implemented as part of applications 614. The illustrated components 602 are not required or all-inclusive, as any components can deleted and other components can be added.

Exemplary Operating Environment

Figure 7:
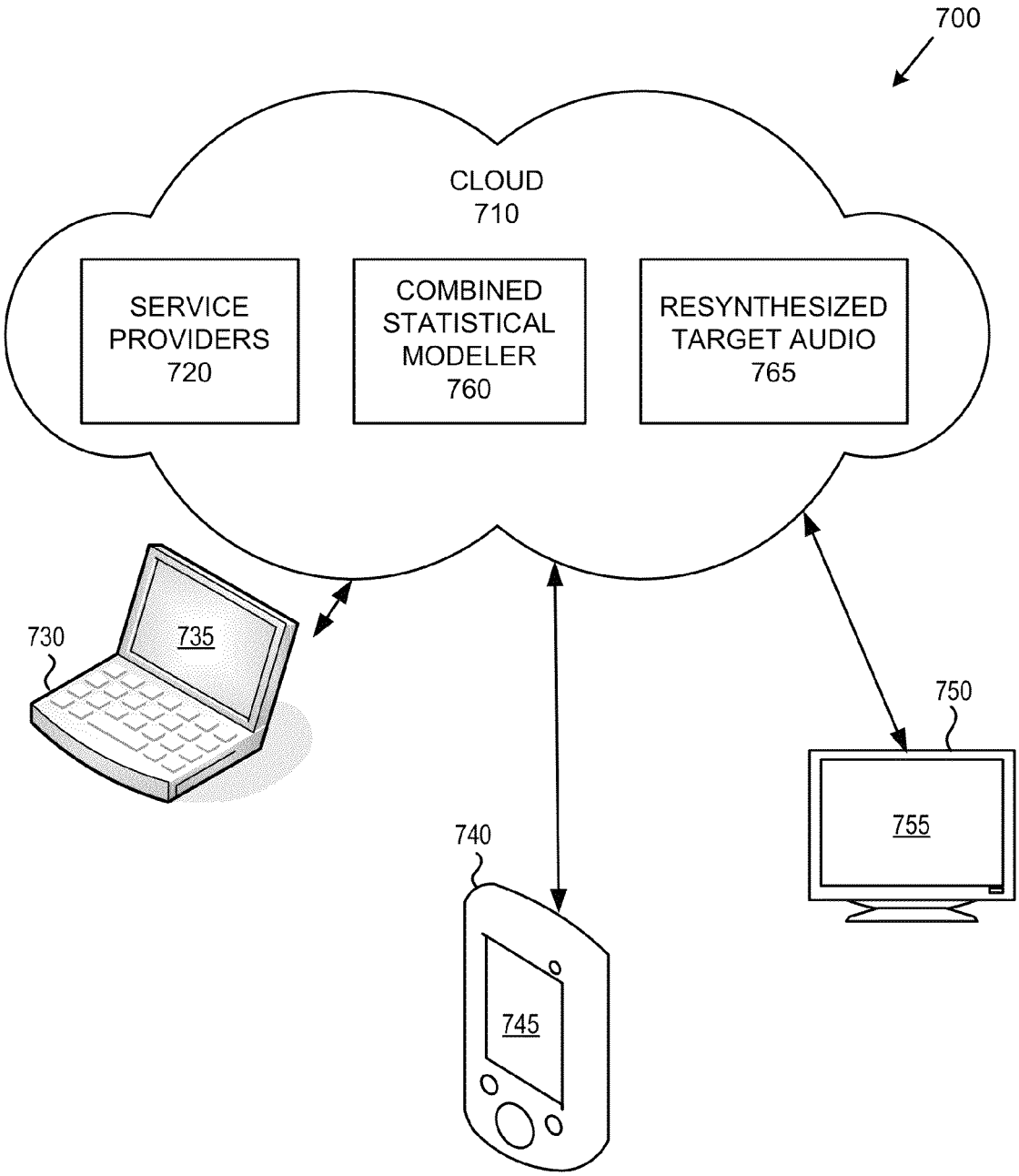
FIG. 7 is a diagram illustrating a generalized example of a suitable implementation environment for any of the disclosed embodiments.

FIG. 7 illustrates a generalized example of a suitable implementation environment 700 in which described embodiments, techniques, and technologies may be implemented.

In example environment 700, various types of services (e.g., computing services) are provided by a cloud 710. For example, the cloud 710 can comprise a collection of computing devices, which may be located centrally or distributed, that provide cloud-based services to various types of users and devices connected via a network such as the Internet. The implementation environment 700 can be used in different ways to accomplish computing tasks. For example, some tasks (e.g., processing user input and presenting a user interface) can be performed on local computing devices (e.g., connected devices 730, 740, 750) while other tasks (e.g., storage of data to be used in subsequent processing) can be performed in the cloud 710.

In example environment 700, the cloud 710 provides services for connected devices 730, 740, 750 with a variety of screen capabilities. Connected device 730 represents a device with a computer screen 735 (e.g., a mid-size screen). For example, connected device 730 could be a personal computer such as desktop computer, laptop, notebook, netbook, or the like. Connected device 740 represents a device with a mobile device screen 745 (e.g., a small size screen). For example, connected device 740 could be a mobile phone, smart phone, personal digital assistant, tablet computer, or the like. Connected device 750 represents a device with a large screen 755. For example, connected device 750 could be a television screen (e.g., a smart television) or another device connected to a television (e.g., a set-top box or gaming console) or the like. One or more of the connected devices 730, 740, 750 can include touchscreen capabilities. Touchscreens can accept input in different ways. For example, capacitive touchscreens detect touch input when an object (e.g., a fingertip or stylus) distorts or interrupts an electrical current running across the surface. As another example, touchscreens can use optical sensors to detect touch input when beams from the optical sensors are interrupted. Physical contact with the surface of the screen is not necessary for input to be detected by some touchscreens. Devices without screen capabilities also can be used in example environment 700. For example, the cloud 710 can provide services for one or more computers (e.g., server computers) without displays.

Services can be provided by the cloud 710 through service providers 720, or through other providers of online services (not depicted). For example, cloud services can be customized to the screen size, display capability, and/or touchscreen capability of a particular connected device (e.g., connected devices 730, 740, 750).

In example environment 700, the cloud 710 provides the technologies and solutions described herein to the various connected devices 730, 740, 750 using, at least in part, the service providers 720. For example, the service providers 720 can provide a centralized solution for various cloud-based services. The service providers 720 can manage service subscriptions for users and/or devices (e.g., for the connected devices 730, 740, 750 and/or their respective users).

In some embodiments, combined statistical modeler 760 and resynthesized target audio 765 are stored in the cloud 710. Audio data or an estimated angle can be streamed to cloud 710, and combined statistical modeler 760 can model the estimated angle as a combined statistical distribution in cloud 710. In such an embodiment, potentially resource-intensive computing can be performed in cloud 710 rather than consuming the power and computing resources of connected device 740. Other functions can also be performed in cloud 710 to conserve resources. In other embodiments, resynthesized target audio 760 can be provided to cloud 710 for backup storage.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

Any of the disclosed methods can be implemented as computer-executable instructions stored on one or more computer-readable storage media (e.g., non-transitory computer-readable media, such as one or more optical media discs, volatile memory components (such as DRAM or SRAM), or nonvolatile memory components (such as hard drives)) and executed on a computer (e.g., any commercially available computer, including smart phones or other mobile devices that include computing hardware). Any of the computer-executable instructions for implementing the disclosed techniques as well as any data created and used during implementation of the disclosed embodiments can be stored on one or more computer-readable media (e.g., non-transitory computer-readable media, which excludes propagated signals). The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or other such network) using one or more network computers.

For clarity, only certain selected aspects of the software-based implementations are described. Other details that are well known in the art are omitted. For example, it should be understood that the disclosed technology is not limited to any specific computer language or program. For instance, the disclosed technology can be implemented by software written in C++, Java, Perl, JavaScript, Adobe Flash, or any other suitable programming language. Likewise, the disclosed technology is not limited to any particular computer or type of hardware. Certain details of suitable computers and hardware are well known and need not be set forth in detail in this disclosure.

It should also be well understood that any functionally described herein can be performed, at least in part, by one or more hardware logic components, instead of software. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

We claim:

1. One or more computer-readable memory or storage devices storing instructions that, when executed by a computing device having a processor, perform a method of separating audio sources in a multi-microphone system, the method comprising:

receiving audio sample groups, with an audio sample group comprising at least two samples of audio information, the at least two samples captured by different microphones during a sample group time interval; and for a plurality of audio sample groups:

estimating, for the corresponding sample group time interval, an angle between a first reference line extending from an audio source to the multi-microphone system and a second reference line extending through the multi-microphone system, the estimated angle being based on a phase difference between the at least two samples in the audio sample group;

modeling the estimated angle as a combined statistical distribution, the combined statistical distribution being a mixture of a target audio signal statistical distribution and a noise component statistical distribution; and determining whether the audio sample group is part of a target audio signal or a noise component based at least in part on the combined statistical distribution.

2. The one or more computer-readable memory or storage devices of claim 1, further comprising resynthesizing a target audio signal from the audio sample groups determined to be part of the target audio signal.

3. The one or more computer-readable memory or storage devices of claim 1, wherein the multi-microphone system is a two-microphone system, and wherein the audio sample groups are audio sample pairs.

4. The one or more computer-readable memory or storage devices of claim 1, wherein determining whether the audio sample group is part of the target audio signal or the noise component comprises comparing the combined statistical distribution to a fixed threshold.

5. The one or more computer-readable memory or storage devices of claim 1, wherein determining whether the audio sample group is part of the target audio signal or the noise component comprises performing statistical analysis.

6. The one or more computer-readable memory or storage devices of claim 5, wherein the statistical analysis comprises hypothesis testing.

7. The one or more computer-readable memory or storage devices of claim 6, wherein the hypothesis testing is maximum a posteriori (MAP) hypothesis testing.

8. The one or more computer-readable memory or storage devices of claim 6, wherein the hypothesis testing is maximum likelihood testing.

9. The one or more computer-readable memory or storage devices of claim 1, wherein the target audio signal statistical distribution and the noise component statistical distribution are von Mises distributions.

10. The one or more computer-readable memory or storage devices of claim 1, wherein the combined statistical distribution is represented by the equation $f_Z(\theta)=c_0[m]f_0(\theta)+c_1[m]f_1(\theta)$, where m is a sample group index, $f_0(\theta)$is a noise component distribution, $f_1(\theta)$ is a target audio signal distribution, $c_0[m]$ and $c_1[m]$ are mixture coefficients, and $c_0[m]+c_1[m]=1$.

11. The one or more computer-readable memory or storage devices of claim 1, wherein parameters for the combined statistical distribution are obtained using an expectation maximization (EM) algorithm.

12. The one or more computer-readable memory or storage devices of claim 1, wherein an initial threshold for distinguishing target audio signal from noise component is a predetermined fixed value.

13. The one or more computer-readable memory or storage devices of claim 1, wherein the second reference line is perpendicular to a third reference line extending between the first and second microphones, and wherein the first reference line and the second reference line intersect at the approximate midpoint of the third reference line.

14. The one or more computer-readable memory or storage devices of claim 1, wherein the sample group time intervals are about approximately between 50 and 125 milliseconds.

15. A multi-microphone mobile device having audio source-separation capabilities, the mobile device comprising:

a first microphone;

a second microphone;

a processor;

an angle estimator configured to, by the processor, for a sample pair time interval, estimate an angle between a first reference line extending from an audio source to the mobile device and a second reference line extending through the mobile device, the estimated angle being based on a phase difference between a first sample and a second sample in an audio sample pair captured during the sample pair time interval, wherein the first sample is captured by the first microphone and the second sample is captured by the second microphone;

a combined statistical modeler configured to model the estimated angle as a combined statistical distribution, the combined statistical distribution being a mixture of a target audio signal statistical distribution and a noise component statistical distribution; and a sample classifier configured to determine whether the audio sample pair is part of a target audio signal or a noise component based at least in part on the combined statistical distribution.

16. The multi-microphone mobile device of claim 15, wherein the mobile device is a mobile phone.

17. The multi-microphone mobile device of claim 15, wherein the sample classifier is further configured to determine whether the audio sample pair is part of the target audio signal or the noise component by performing statistical analysis.

18. The multi-microphone mobile device of claim 17, wherein the statistical analysis comprises at least one of maximum a posteriori (MAP) hypothesis testing or maximum likelihood testing.

19. The multi-microphone mobile device of claim 15, wherein the sample classifier is further configured to determine whether the audio sample pair is part of the target audio signal or the noise component by comparing the combined statistical distribution to a fixed threshold.

20. The multi-microphone mobile device of claim 15, wherein the second reference line is perpendicular to a third reference line extending between the first and second microphones, and wherein the first reference line and the second reference line intersect at an approximate midpoint of the third reference line.

21. The multi-microphone mobile device of claim 15, wherein the target audio signal statistical distribution and the noise component statistical distribution are von Mises distributions, and wherein the combined statistical modeler is further configured to determine parameters for the combined statistical distribution using an expectation maximization (EM) algorithm.

22. A method of providing a target audio signal through audio source separation in a two-microphone system, the method comprising:

receiving audio sample pairs, with an audio sample pair comprising a first sample of audio information captured by a first microphone during a sample pair time interval and a second sample of audio information captured by a second microphone during the sample pair time interval;

for a plurality of audio sample pairs:

estimating, for the corresponding sample pair time interval, an angle between a first reference line extending from an audio source to the two-microphone system and a second reference line extending through the two-microphone system, the estimated angle being based on a phase difference between the first and second samples of audio information;

modeling the estimated angle as a combined statistical distribution, the combined statistical distribution being a mixture of a target audio signal von Mises distribution and a noise component von Mises distribution; and performing hypothesis testing statistical analysis on the combined statistical distribution to determine whether the audio sample pair is part of the target audio signal or the noise component; and resynthesizing a target audio signal from the audio sample pairs determined to be part of the target audio signal.

23. The method of claim 22, wherein the hypothesis testing is one of maximum a posteriori (MAP) hypothesis testing or maximum likelihood testing.

24. The method of claim 22, wherein parameters for the combined statistical distribution are obtained using an expectation maximization (EM) algorithm.

* * * * *